US005611640A

United States Patent [19]

Bowman

[11] Patent Number: 5,611,640

[45] Date of Patent: Mar. 18, 1997

[54] METHOD AND APPARATUS FOR ANCHORING A UTILITY GRATE COVER

[76] Inventor: Harold M. Bowman, 18867 N. Valley Dr., Fairview Park, Ohio 44126

[21] Appl. No.: 517,656

[22] Filed: Aug. 22, 1995

Related U.S. Application Data

[63] Continuation of Ser. No. 250,272, May 27, 1994.

[51] Int. Cl.[6] ..... E02D 29/14

[52] U.S. Cl. ..... 404/4; 404/26; 49/463

[58] Field of Search ..... 404/3, 4, 5, 26; 49/463, 465; 210/163, 164, 166; 52/302.1, 169.5

[56] References Cited

U.S. PATENT DOCUMENTS

| | | |
|---|---|---|
| Re. 34,550 | 2/1994 | Bowman . |
| D. 247,254 | 2/1978 | Brown et al. . |
| 911,256 | 2/1909 | McWane . |
| 922,892 | 5/1909 | Harrington . |
| 953,858 | 4/1910 | Rice et al. . |
| 1,001,041 | 8/1911 | Jones . |
| 1,016,081 | 1/1912 | McNulty . |
| 1,071,577 | 8/1913 | Rego . |
| 1,073,150 | 9/1913 | Linskie . |
| 1,102,422 | 7/1914 | McKeon . |
| 1,131,327 | 3/1915 | Caldwell . |
| 1,152,618 | 9/1915 | Farris . |
| 1,163,189 | 12/1915 | Wolf . |
| 1,177,850 | 4/1916 | Dougherty . |
| 1,191,431 | 7/1916 | Jones . |
| 1,191,432 | 7/1916 | Jones . |
| 1,191,497 | 7/1916 | Dauphinee . |
| 1,287,290 | 12/1918 | Golden . |
| 1,384,712 | 7/1921 | Shanley . |
| 1,388,492 | 8/1921 | Thomsen . |
| 1,400,399 | 12/1921 | Yaeche . |
| 1,417,377 | 5/1922 | Gschwind . |
| 1,542,900 | 6/1925 | Maddocks . |
| 1,602,713 | 10/1926 | Shanley . |
| 1,610,123 | 12/1926 | Fairweather . |
| 1,683,365 | 9/1928 | Loudenslager et al. . |
| 1,693,190 | 11/1928 | Benedetti . |
| 1,717,364 | 6/1929 | Borland . |
| 1,721,831 | 7/1929 | Porter . |
| 1,892,830 | 1/1933 | Dougherty . |
| 1,898,871 | 2/1933 | Ellis . |
| 1,926,595 | 9/1933 | Mulvihill . |
| 1,959,171 | 5/1934 | Mayer . |
| 1,962,881 | 6/1934 | Shanley . |
| 1,988,360 | 1/1935 | Moore . |
| 2,009,132 | 7/1935 | Gehris . |
| 2,051,172 | 8/1936 | Kramer . |
| 2,109,287 | 2/1938 | Elkington . |

(List continued on next page.)

OTHER PUBLICATIONS

Drawing from New York State's Department of Transportation, date unknown.

P.C. Perdikaris, P.E., Ph.D., Technical Civil Engineering Report, Mar. 15, 1988.

Japanese publication entitled "Reinforced Concrete Manhole Blocks For Sewerage Work", by Jap. Standards Assoc., published 1990.

Japanese publication entitled "Manhole Cover for Sewerage", by Japanese Standards Assocation, published 1987.

NOPCO brochure, "Adjeis–To–Grade With Safe–Tite Seal"; Copyright 1989.

Grate Locking Device brochure. Date and Author unknown.

*Primary Examiner*—William P. Neuder

*Attorney, Agent, or Firm*—Watts, Hoffmann, Fisher & Heinke Co.

[57] ABSTRACT

A frame insert for raising the level of a drainage grate cover with respect to a catch basin frame. The frame insert includes a lug for providing a locking surface for a lock device connected to the grate cover. The lug permits a pre-existing lock which locked the grate cover to the catch basin frame to be used to lock the grate cover to the frame insert. The lock engages the frame insert lug at a new lock position which is approximately ninety degrees from the position where it locked the grate cover to the frame before installation of the insert.

12 Claims, 4 Drawing Sheets

U.S. PATENT DOCUMENTS 2,113,713 4/1938 Slocum .
2,114,499 4/1938 Maclear .
2,535,275 12/1950 Dixon .
2,682,211 6/1954 Avila .
2,697,389 12/1954 Heckman .
2,817,274 12/1957 Benoit .
2,967,389 12/1961 Heckman .
3,217,619 11/1965 Driver et al. .
3,408,778 11/1968 Mason .
3,426,659 2/1969 Clarke .
3,773,428 11/1973 Bowman .
3,858,998 1/1975 Larson et al. .
3,920,347 11/1975 Sauriol et al. .
3,921,494 11/1975 Coe .
3,926,533 12/1975 Binette .
3,930,739 1/1976 Larsson et al. .
3,945,746 3/1976 Bredbenner .
3,969,847 7/1976 Campagna et al. .
3,973,856 8/1976 Gaglioti .
3,977,124 8/1976 Oger .
4,000,953 1/1977 Langeliers et al. .
4,015,373 4/1977 Boissier .
4,029,425 6/1977 Pelsue .
4,030,851 6/1977 Graybeal .
4,038,789 8/1977 Axgarde et al. .
4,061,434 12/1977 Carroll .
4,067,659 1/1978 Campagna, Jr. et al. .
4,075,796 2/1978 Cuozzo .
4,089,139 5/1978 Moffa et al. .
4,097,228 6/1978 Rosling .
4,123,184 10/1978 Whitlock .
4,145,151 3/1979 Helms .
4,187,647 2/1980 Hall .
4,188,151 2/1980 Hall .
4,197,031 4/1980 Hild .
4,203,686 5/1980 Bowman .
4,273,467 6/1981 Cronk .
4,281,944 8/1981 Bowman .
4,440,407 4/1984 Gagas .
4,582,449 4/1986 Vosswinkel .
4,582,450 4/1986 Neil .
4,637,752 1/1987 Centa .
4,763,449 8/1988 Vigneron et al. .
4,834,574 5/1989 Bowman .
4,867,600 9/1989 Bowman .
4,872,730 10/1989 Bowman .
4,927,290 5/1990 Bowman .
4,963,053 10/1990 Bowman .
4,966,489 11/1990 Bowman .
4,969,770 11/1990 Bowman .
4,969,771 11/1990 Bowman .
5,021,261 6/1991 Bowman .
5,039,248 8/1991 Bowman .
5,051,022 9/1991 Bowman .
5,143,478 9/1992 Bowman .
5,150,984 9/1992 Bowman .
5,165,819 11/1992 Bowman ..... 404/26
5,184,912 2/1993 Bowman .

METHOD AND APPARATUS FOR ANCHORING A UTILITY GRATE COVER

This application is a continuation of application Ser. No. 08/250,272, filed May 27, 1994.

BACKGROUND OF THE INVENTION

1. Field of the Invention

This invention relates to a locking arrangement for locking a drainage grate cover to a utility frame insert which is fitted to a utility access hole or catch basin frame.

2. Description of the Related Art

Road surfaces have numerous openings to permit drainage of rainwater. Typically, the openings are covered with generally rectangular grate covers, which are mounted flush with the road surface. The grate covers are designed to rest on a rectangular flange or rim of a utility access frame, also known and referred to herein as a catch basin frame. Grate cover locking devices are widely used to lock drainage grate covers to their associated catch basin frames.

FIG. 5 illustrates a prior art locking arrangement for a typical grate cover as installed when a roadway is first built. In a typical installation, one side of the grate cover is held in position by a releasable locking device which usually consists of a bolt extending downward from the grate cover. The head of the bolt is accessible from above. As seen in FIG. 5, the opposite side of the grate cover is maintained in position by a metal strap which also engages the underside of the rim on which the grate cover rests. To install the grate cover, the side which includes the strap is inserted first in order to position the strap below the rim. The cover is than pivoted downwardly until the opposite side (the side including the locking device) rests on the rim. During installation, the locking member is rotated to an inward, neutral position (not shown) to avoid interference with the rim. Once the grate is positioned onto the rim, the locking member is then rotated outward to extend beneath the rim and the bolt is tightened. Since the head of the bolt is connected to the grate cover, tightening the bolt serves to clamp the grate cover to the rim.

When roadways are repaved, the grate covers must be raised to the level of the new pavement surface. This is often accomplished by placing a frame insert having a height matching the height of the added paving material on the rim of the catch basin frame and then placing the grate cover on the insert. This solves the problem of raising the grate cover but it renders the existing grate cover lock unusable because the lock bolt can no longer reach beneath the rim of the catch basin frame. Simply lengthening these bolts causes other problems and is not a viable solution.

FIG. 6 illustrates one prior art attempt to solve this problem. In this prior art construction, a notch was machined or formed in the frame insert to define an engagement surface for the lock member. On the side of the insert opposite the side in which the notch or notches were formed, an engagement bar was welded which served as an engagement stop for the metal retaining strap. While this solved the problem, it added a machining step to the manufacture of the frame inserts and has proven to be costly and inefficient. Thus, there is a need for a simple inexpensive solution to the problem.

SUMMARY OF THE INVENTION

Basically, the invention is a frame insert for raising the level of a drainage grate cover with respect to a catch basin frame. The insert includes a top surface for engaging and supporting a drainage grate cover and a bottom surface for engaging a rim of a catch basin frame. The insert includes an inner wall located between the top and bottom surfaces which defines a drainage opening. The insert includes a lug projecting from said inner wall into said drain opening. The lug is adapted to engage a lock connected to the grate cover.

In one preferred and illustrated embodiment, the lug is connected to a plate which is fastened to the wall of the insert.

In another preferred embodiment, the lug is welded directly to the inner wall of the insert.

In another preferred embodiment, a frictional coating or frictional material is applied to the surface that is engaged by the locking device to further resist relative rotation between the locking device and the lug.

A preferred method of modifying an existing insert includes the step of fastening a lug to the inner wall of the insert at a predetermined location.

BRIEF DESCRIPTION OF THE DRAWINGS

Preferred embodiments of the invention are shown in the accompanying drawings in which.

DESCRIPTION OF THE PREFERRED EMBODIMENTS

Figure 5:
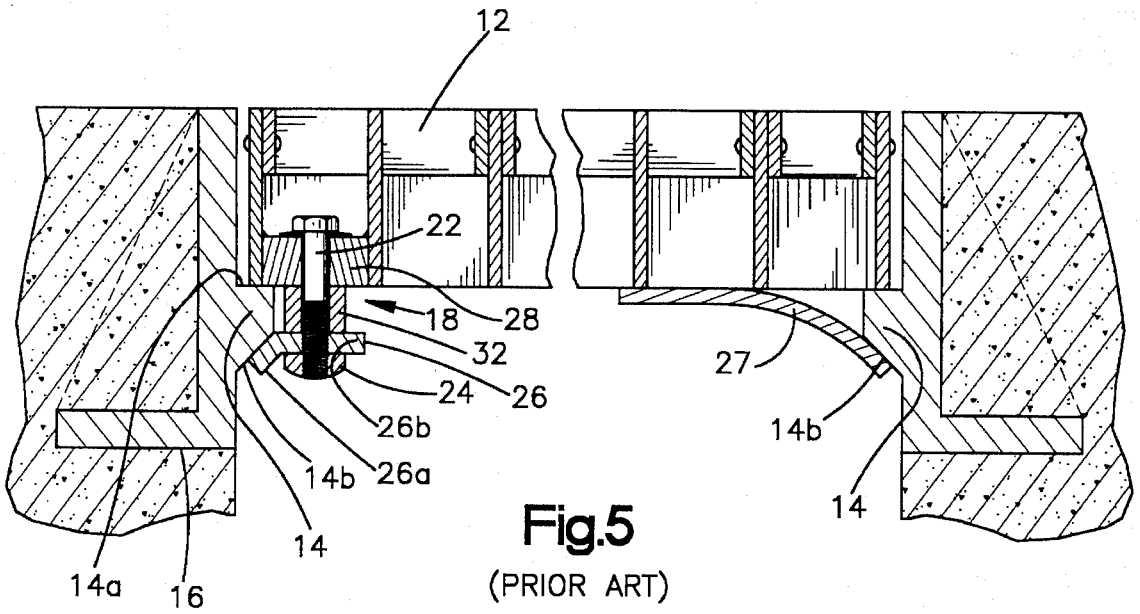
Fig.5 (PRIOR ART)
FIG. 5 is a cross sectional side view of a prior art grate cover locking device with parts broken away.

Referring to FIG. 5, a typical roadway drain is shown. The drain includes a catch basin frame 16, and a grate cover 12. The catch basin frame 16 includes a rim 14 extending about its inner wall. The rim 14 has a horizontal upper surface **14*a* and an angled lower surface 14*b*. The grate cover 12 is shown supported by the rim 14 of the catch basin frame 16**.

The grate cover 12 includes a lock device 18 which has a bolt 22, a nut 24, and a lock member 26. The lock member 26 includes a toe portion **26*a* and a heel portion 26*b*. The head of the bolt 22 rests above a horizontal support 28, which is fixed to the grate cover 12. A spacer sleeve 32 may be provided between the lock member 26 and the horizontal support 28. When the bolt is tightened from above, the grate 12 is clamped to the rim 14 by the lock member 26**.

The grate cover 12 also includes a retaining strap 27 which, in the typical construction is a metal strip welded to the underside of the grate. Typically, the strap 27 is bendable and is of an extent which allows it to abuttably engage the angled lower surface **14*b***.

The grate is installed by maneuvering the grate cover until strap 27 engages the surface 14*b*. The grate is then pivoted downwardly until the opposite side rests on the seat surface 14*a*. The lock member 26 is then rotated until it lies below the surface 14*b* and then the bolt is tightened.

Figure 6:
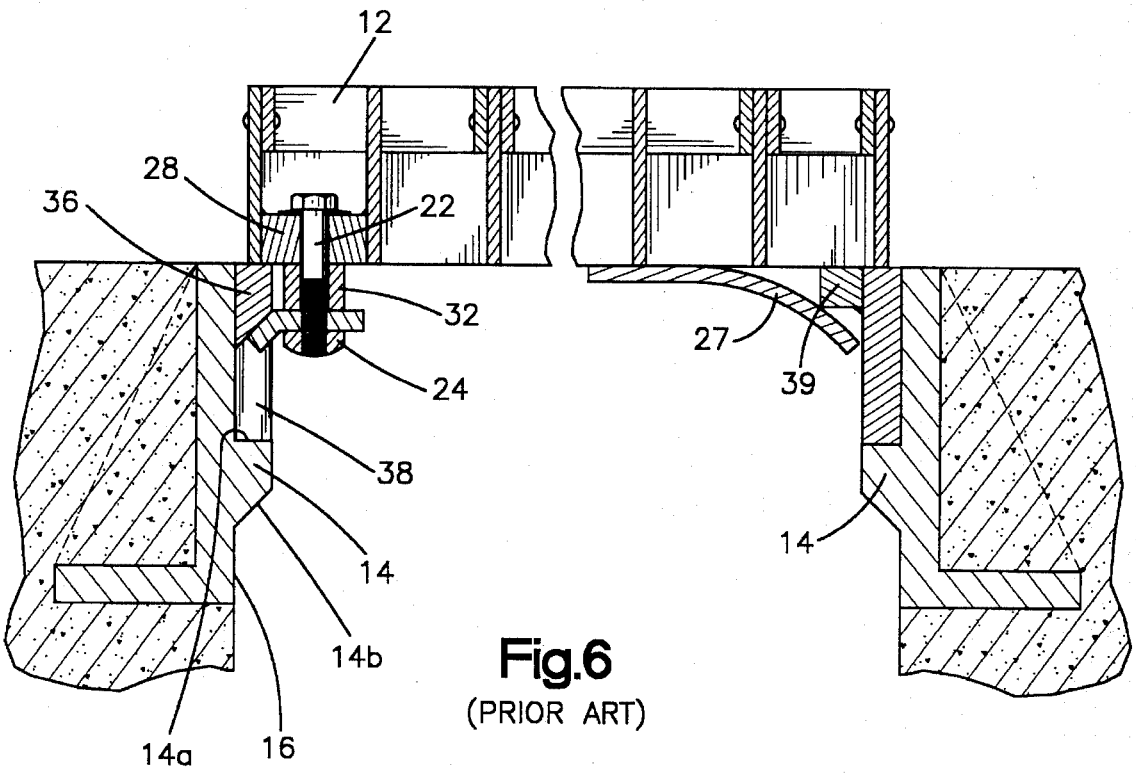
Fig.6 (PRIOR ART)
FIG. 6 is an elevational cross section view of a prior art modified frame insert with parts broken away.

FIG. 6 shows the catch basin frame 16 with an insert 36 according to the prior art. The insert 36 serves the purpose of raising the grate 12 to a higher level when the roadway is repaved. A notch 38 has been machined into the wall of the insert 36 to provide a place for the lock member 26 to engage the insert 36 to secure the grate 12. This arrangement permits the pre-existing grate 12 and lock device 18 to be reused after a paving operation.

The side of the grate opposite the side that includes the locking device, is maintained in position by the engagement between the retaining strap 27 and a bar 39 welded to the insert.

Figure 1:
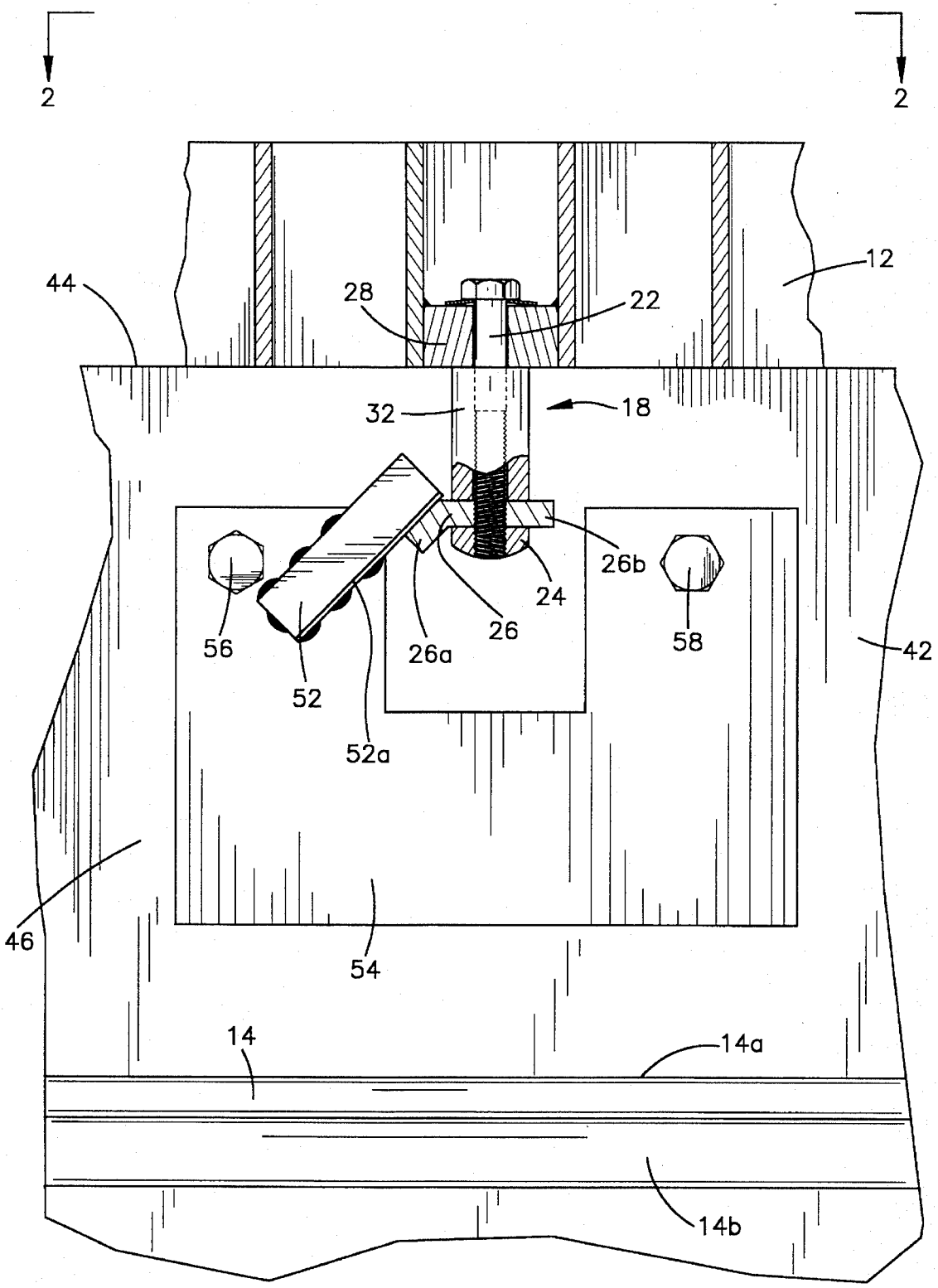
FIG. 1 is a side elevational view of the modified insert of the present invention in partial cross section as seen approximately from the plane indicated by the line 1—1 of FIG. 2.

Referring to FIG. 1, an insert 42 according to the invention is shown. Like the prior art insert 36, the insert 42 is supported by the rim 14 of the catch basin frame 16. That is, the bottom surface of the insert 42 rests on the top surface 14*a* of the rim 14. The grate 12 is supported by the insert 42. That is, the bottom surface of the periphery of the grate 12 rests on the top surface 44 of the insert 42. The illustrated insert 42 is similar to the insert disclosed in U.S. Pat. No. 5,039,248 titled Support for Catch Basin Cover, which is incorporated herein by reference. The insert 42 has in inner wall 46 located between the upper and lower surfaces which defines a drain opening 48. A keeper wall 50 is connected to the insert 42 and surrounds the grate 12. The insert 42 may have varying sizes and characteristics according to the requirements of the particular application. For example, the insert 42 may be circular in plan view.

Figure 2:
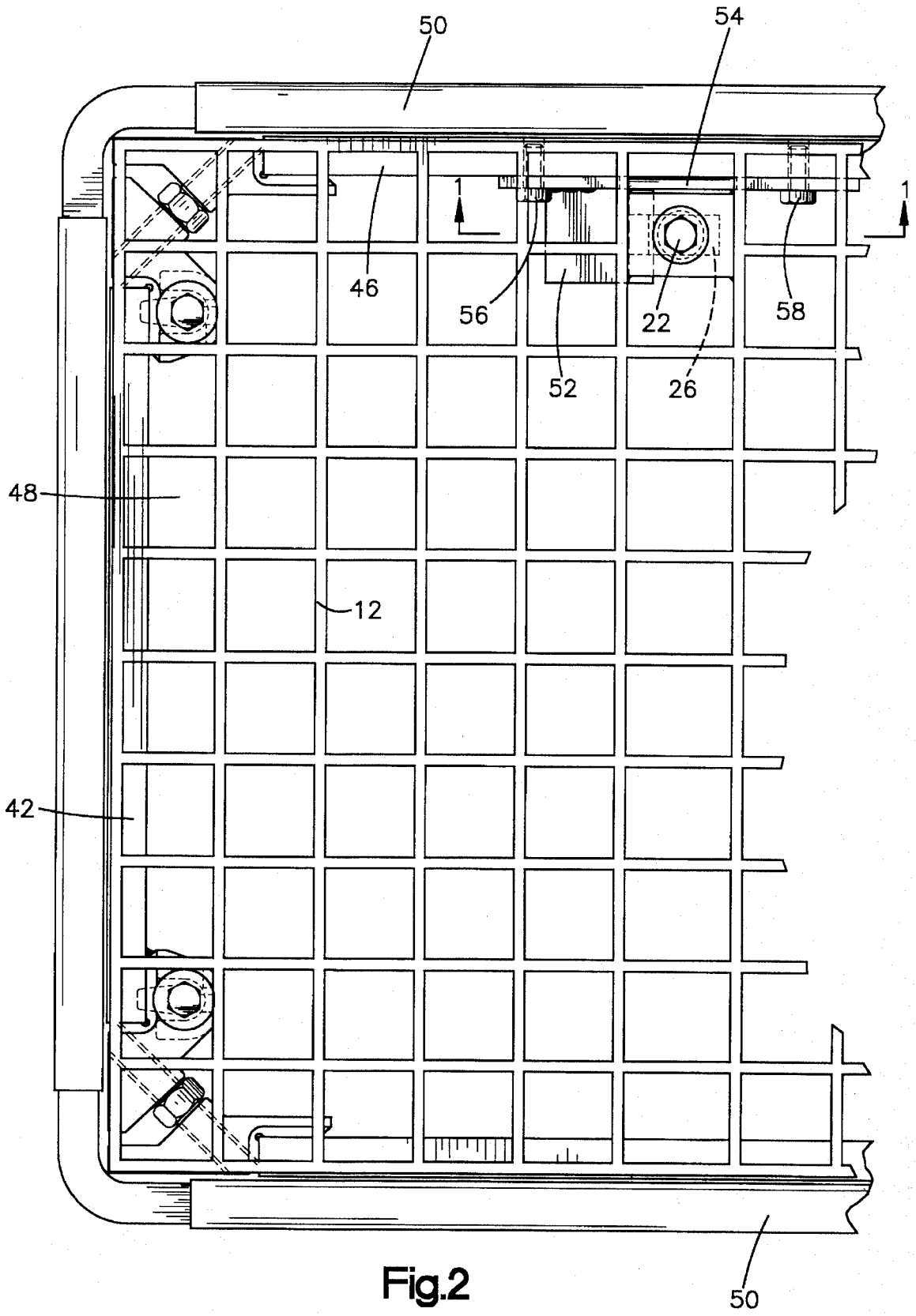
FIG. 2 is a partial top plan view of the modified frame insert of FIG. 1 as seen approximately from the plane indicated by the line 2—2 of FIG. 1.

Referring to FIGS. 1 and 2, a lug 52 is attached to the inner wall 46 of the insert 42 for providing a new surface for the pre-existing lock member 26 to engage. The lug 52 projects from the inner wall 46 into the drain opening 48. The lug 52 is located a predetermined distance below the upper surface 44 of the insert 42 such that the lock member 26 can engage the lug 52 in the same way that it previously engaged the lower surface 14*b* of the rim 14. In the preferred and illustrated embodiments, the lug 52 is simply a rectangular member, but it may have many configurations. The lug 52 is attached at an angle of approximately 45 degrees to the horizontal plane containing the rim 14. Thus, the lower surface of the lug 52 approximates the angle of the lower surface 14*b* of the rim 14.

In one embodiment of the invention, the lower surface may include a layer or coating of frictional material. The frictional material 52*a* provides added resistance to relative movement between the lower surface of the lug 52 and the lock member 26 as the bolt 22 is tightened during installation. In the embodiment of FIG. 1, the lug 52 is welded to a plate 54 which is bolted to the inner wall 46 with a pair of bolts 56, 58. Thus, the lug 52 may be readily removed or attached.

The lock member 26 must be moved to a neutral position when the grate 12 is installed to avoid interference between the lock member 26 and the lug 52. Preferably, prior to installation of the grate, the lock member is moved to a position which is one quarter-turn counterclockwise from the position it occupies in FIG. 2. In this position, the lock member 26 will avoid contact with other parts when being lowered into the frame 16. Once the grate 12 is seated on the rim 14, the bolt 22 is turned or the lock member 26 is otherwise manipulated to locate the toe portion 26*a* beneath the lug 52 as in the locking position shown in FIGS. 1 and 2. The workmen may have to remove some metal from the heel end 26*b* of the lock member 26 to avoid interference between the heel portion 26*b* and the inner wall 46 of the insert 42 when the lock member 26 is in its neutral position.

Figure 3:
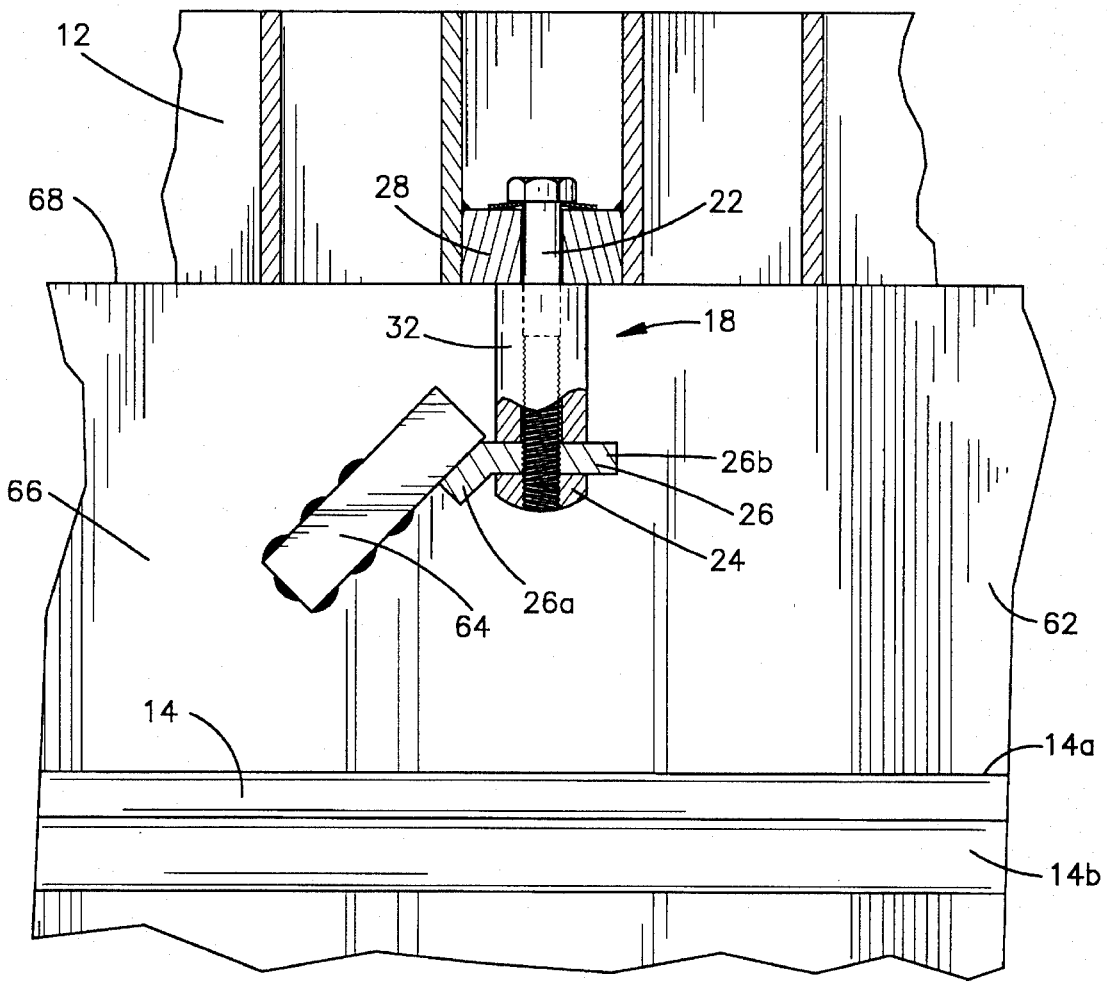
FIG. 3 is a side elevational view of a second embodiment of the modified insert in partial cross section as seen from the same direction as FIG. 1.
Figure 4:
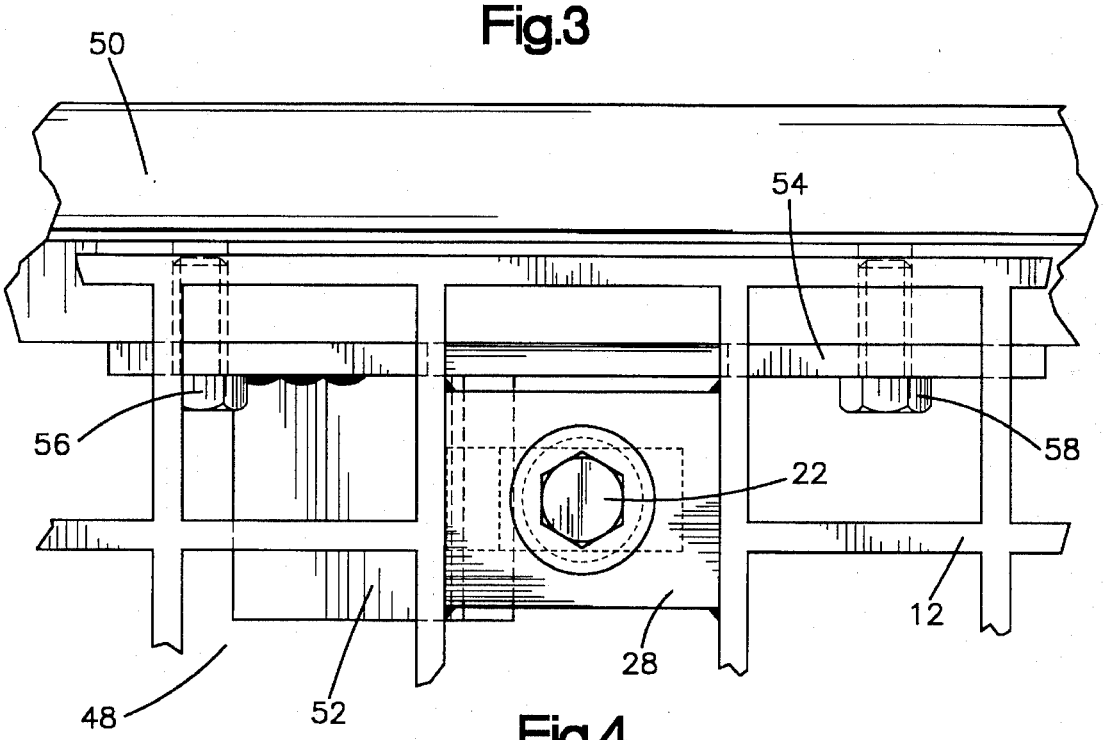
FIG. 4 is an enlarged partial top plan view of the modified frame insert of FIGS. 1 and 2 including a fragmentary grate cover and a grate cover lock device.

Referring to FIG. 3, a second embodiment of the insert of the present invention is shown. An insert 62 is shown which is identical to the insert 42 of FIGS. 1 and 2 except that a lug 64 is welded directly to an inner wall 66 to project into the drain opening 48. Again, the lug 64 is located at a predetermined distance below a top surface 68 of the insert 62 to be within the reach of the lock member 26 when the grate 12 is installed and it is angled to approximate the angle of the lower rim surface 14*b*.

At a minimum, to modify existing inserts to permit reuse of the pre-existing grates, one need only weld the lug 64 to the inner wall 66 in the proper position. This can be done in the field without the benefit of a machine shop and is simpler and less expensive than the prior art method. If the lock member heels 26*b* require shortening as described above, this can also be done readily in the field with portable cutting tools and without the aid of a machine shop.

To install an insert 42 or 62 in a catch basin frame 16 like that of FIG. 5, the grate lock device 18 is first loosened and the lock member 26 is manipulated until it rotates inward and is no longer beneath the rim 14. The grate 12 is then lifted and removed from the frame 16. An insert 42 or 62 is then placed on the frame 16 such that the bottom surface of the insert rests on the top surface 14*a* of the rim 14. Prior to installing the grate 12, the lock member 26 is manipulated such that it is in a neutral position. Then the grate 12 is placed on the top surface of the insert inside the keeper walls 50 as shown in FIG. 2. Once the grate 12 is in place, the bolt 22 is rotated or the lock member 26 is otherwise manipulated until it extends beneath the lug 52 or 64 in a new lock position. This position is approximately one quarter-turn counterclockwise from the locking position used prior to installation of the insert 42 or 62 as viewed in FIG. 2. Finally, the bolt 22 is tightened to secure the grate 12.

While preferred embodiments of this invention have been described in detail, it will be apparent that certain modifications or alterations can be made without departing from the spirit and scope of the invention set forth in the appended claims.

I claim:

1. A frame insert for raising the level of a drainage grate cover with respect to a catch basin frame comprising:

a top surface for engaging and supporting a drainage rate cover;

a bottom surface for engaging a top surface of a rim of the catch basin frame, the rim having an angled surface below the top surface of the rim;

an inner wall located between said top and bottom surfaces defining a drainage opening; and a lug projecting from said inner wall into said drainage opening, said lug having a planar lower surface extending at an angle that is approximately the same as an angle that the angled surface extends with respect to the top surface of the rim, said lug being adapted to have its lower surface engaged by a lock connected to the grate cover.

2. A frame insert according to claim 1 wherein said lug is welded directly to said inner wall.

3. A frame insert according to claim 1 wherein said lug has a planar lower surface and is positioned at an angle of approximately forty five degrees to a plane containing the top surface of the rim.

4. A frame insert for raising the level of a lockable drainage grate cover on a catch basin frame, such grate cover being of a type having a rotatable lock device for engaging a rim of a catch basin frame when rotated to an outward locking position to secure said grate cover to said frame, said insert comprising:

a top surface for receiving said drainage grate cover;

a bottom surface for engaging a rim of the catch basin frame;

an inner wall located between said top and bottom surfaces defining a drain opening; and a lug projecting from said inner wall into said drain opening wherein said lug is adapted to engage said lock device and secure said grate cover to said insert when said lock device is rotated to a position approximately ninety degrees from its outward locking position.

5. A frame insert according to claim 4 wherein said lug is welded to said inner wall.

6. A method of adapting a frame insert for a catch basin frame to accommodate a pre-existing rotatable lock used to lock a grate cover to said catch basin frame when rotated to a first lock position, such frame insert being of a type including a bottom surface for engaging a rim of a catch basin frame and a top surface for supporting such grate cover and an inner wall surface between said top and bottom surfaces which defines a drain opening, said method comprising the step of attaching a lug to said inner wall surface in a position to protect from said inner wall surface into said drain opening and to be engaged by said lock in a second lock position which is rotated approximately one quarter-turn from said first lock position, and rotating said lock from said first to said second lock position to secure said grate cover to said insert.

7. A frame insert for raising the level of a drainage grate cover with respect to a catch basin frame comprising:

a top surface for engaging and supporting a drainage grate cover;

a bottom surface for engaging a rim of said catch basin frame;

an inner wall located between said top and bottom surfaces defining a drainage opening; and a lug projecting from said inner wall into said drainage opening, said lug being adapted to engage a lock connected to said grate cover, wherein said lug defines a lower surface and a frictional material is applied to at least a portion of said lower surface in a region engageable by said lock.

8. A frame insert for raising the level of a drainage grate cover with respect to a catch basin frame comprising:

a top surface for engaging and supporting a drainage grate cover;

a bottom surface for engaging a rim of said catch basin frame;

an inner wall located between said top and bottom surfaces defining a drainage opening; and a lug projecting from said inner wall into said drainage opening, said lug being adapted to engage a lock connected to said grate cover, wherein said lug defines a frictional lower surface engageable by said lock.

9. A frame insert for raising the level of a lockable drainage grate cover on a catch basin frame, such grate cover being of a type having a rotatable lock device for engaging a rim of a catch basin frame when rotated to an outward locking position to secure said grate cover to said frame, said insert comprising:

a top surface for receiving said drainage grate cover;

a bottom surface for engaging a rim of the catch basin frame.

an inner wall located between said top and bottom surfaces defining a drain opening; and a lug projecting from said inner wall into said drain opening wherein said lug is adapted to engage said lock device and secure said grate cover to said insert when said lock device is rotated to a position approximately ninety degrees from its outward locking position, wherein said lug defines a frictional lower surface engageable by said lock device.

10. A frame insert for raising the level of a drainage grate cover with respect to a catch basin frame comprising:

a top surface for engaging and supporting a drainage grate cover;

a bottom surface for engaging a rim of said catch basin frame;

side walls located between said top and bottom surfaces defining a drainage opening, said top surface, said bottom surface and said side walls forming a paralellepiped; and a lug projecting from an inner surface of one of said walls into said drainage opening, said lug being adapted to engage a lock connected to said grate cover.

11. A frame insert for raising the level of a drainage grate cover with respect to a catch basin frame comprising:

a top surface for engaging and supporting a drainage grate cover;

a bottom surface for engaging a rim of said catch basin frame;

an inner wall located between said top and bottom surfaces defining a drainage opening; and a lug projecting from said inner wall into said drainage opening, said lug being adapted to engage a lock connected to said grate cover, wherein said lug is connected to a plate which is fastened to said inner wall.

12. A frame insert for raising the level of a lockable drainage grate cover on a catch basin frame, such grate cover being of a type having a rotatable lock device for engaging a rim of a catch basin frame when rotated to an outward locking position to secure said grate cover to said frame, said insert comprising:

a top surface for receiving said drainage grate cover;

a bottom surface for engaging a rim of the catch basin frame;

an inner wall located between said top and bottom surfaces defining a drain opening; and a lug projecting from said inner wall into said drain opening wherein said lug is adapted to engage said lock device and secure said grate cover to said insert when said lock device is rotated to a position approximately ninety degrees from its outward locking position, wherein said lug is connected to a plate which is fastened to said inner wall.

* * * * *